US005305808A

United States Patent [19]

Rasmussen et al.

[11] Patent Number: 5,305,808

[45] Date of Patent: Apr. 26, 1994

[54] APPARATUS AND METHOD FOR INSERTING CYLINDRICALLY SHAPED FOOD PRODUCT INTO CONTAINER

[75] Inventors: Glen O. Rasmussen, Champlin; James L. Schurz, New Hope, both of Minn.

[73] Assignee: The Pillsbury Company, Minneapolis, Minn.

[21] Appl. No.: 943,910

[22] Filed: Sep. 11, 1992

[51] Int. Cl.[5] ..... B65B 43/42

[52] U.S. Cl. ..... 141/169; 141/164; 141/165; 141/171; 141/178; 141/242; 141/246; 53/148; 53/236; 53/252; 53/248; 198/562; 221/157; 414/910; 414/745.1

[58] Field of Search ..... 141/1, 129, 163, 164, 141/165, 168, 169, 171, 176, 178, 237, 242, 246; 414/910, 745.1; 53/257, 251, 254, 409, 532, 248, 467, 459, 148, 444, 236, 248.5, 248.6; 198/523, 562; 221/1, 157

[56] References Cited

U.S. PATENT DOCUMENTS

| | | | |
|---|---|---|---|
| 1,235,680 | 8/1917 | Greco | 53/444 |
| 2,975,809 | 3/1961 | Ninneman | 141/178 X |
| 3,267,636 | 8/1966 | Sternberg | 53/284.5 |
| 3,491,804 | 1/1970 | Niclas | 141/164 X |
| 3,812,647 | 5/1974 | Bertling et al. | 141/164 X |
| 4,358,918 | 11/1982 | Groom et al. | 53/467 X |
| 4,713,218 | 12/1987 | Schwartz | 422/99 |
| 4,815,922 | 9/1989 | Midorikawa | 414/910 X |

*Primary Examiner*—Ernest G. Cusick
*Attorney, Agent, or Firm*—Kinney & Lange

[57] ABSTRACT

A device for loading dough into cylindrical containers is disclosed. A first conveyor is provided which delivers a plurality of cylindrical containers to a receiving surface which is declining with respect to the horizontal. The containers are oriented such that a central cylindrical axis of each container is substantially parallel to the container receiving surface as the containers approach the container receiving surface. A second conveyor then delivers a cylindrical object to the receiving surface in a direction that is substantially perpendicular to path of the containers in the first conveyor as the objects approach the container receiving surf ace. The second conveyor aligns the cylindrical objects and causes the objects to be inserted into the cylindrical container. Means for positioning the container on the container receiving surface and for releasing the cylindrical containers after filling is also provided. A method of inserting cylindrical objects into cylindrical containers is also disclosed.

14 Claims, 7 Drawing Sheets

12
20
43
18
10
22
40
44A
28
44
15
44
44B

APPARATUS AND METHOD FOR INSERTING CYLINDRICALLY SHAPED FOOD PRODUCT INTO CONTAINER

BACKGROUND OF THE INVENTION

The present invention relates generally to an apparatus for loading a product into a like-shaped container and more particularly to an apparatus f or loading frozen or refrigerated cylindrical pieces of dough into cylindrical containers.

Consumers enjoy eating home-baked cookies and other baked products, but consumers do not want to spend the time required to select a recipe, assemble the ingredients, and mix the ingredients together in the manner specified in the recipe. The food industry has developed many ready-to-bake products that eliminate the time consuming steps in preparing the dough. One such conventional ready-to-bake cookie dough has the following composition:

| Conventional Cookie Dough Composition | |
|---|---|
| Ingredient | Weight Percent |
| sugar | 24.319 |
| flour | 28.389 |
| soda | 0.490 |
| salt | 0.490 |
| egg yolk solids | 0.786 |
| albumen | 0.890 |
| enrichment | 0.004 |
| shortening | 13.879 |
| oil | 1.542 |
| Water | 10.302 |
| molasses | 2.140 |
| vanilla | 0.103 |
| candy pieces | 16.666 |
| | 100.000 |

The dough is maintained at a temperature of about 40 degrees Fahrenheit and is extruded into a rope-shape. The rope is cut into individual portions. Then, the outer layers of the dough are frozen by known means such as a liquid nitrogen freezer. The frozen surface of the dough is less tacky than at refrigeration temperatures, and therefore the dough is easier to handle. However, the dough cannot be completely frozen because it becomes brittle and splits. Although the frozen surfaces are less tacky than the refrigerated dough surfaces, the frozen surfaces do not slide easily over smooth surfaces. There are currently no publicly known methods for packaging prepared refrigerated dough into cylindrical containers.

Refrigerated dough products are typically packaged in spiral wound composite cans such as the can configuration shown in McDilda et al. U.S. Pat. No. 5,084,284 issued Jan. 28, 1992 and assigned to the Pillsbury Company of Minneapolis, Minnesota. The dough products can also be packaged in metallic cans such as aluminum or tin cans, or in plastic containers.

In each instance, there is no known device for inserting cylindrical shaped objects having tacky surfaces into a cylindrically shaped can such as one or more of the containers described above.

SUMMARY OF THE INVENTION

The present invention is a device for loading food products into cylindrical containers. The device of the present invention allows pieces of dough or other products having tacky exterior surfaces to be loaded into cylindrical containers on a continuous basis.

The device of the present invention includes a support frame. Pivotally mounted onto the support frame is a container receiving surface which is located within a plane which is declining with respect to a horizontal plane. The intersection of the plant containing the container receiving surface and the horizontal is defined as the first angle. In the preferred embodiment, this first angle is between about 20 and about 40 degrees, with a preferred angle of about 30 degrees.

A first conveyor is provided which delivers a plurality of cylindrical containers to the receiving surface. The first conveyor is oriented such that a central cylindrical axis of each container approaches the container receiving surface substantially parallel to that surface. An exit end of the first conveyor is mounted above the container receiving surface such that the containers are delivered in a path defined by a line which is substantially perpendicular to the container receiving surface.

A second conveyor is provided to deliver at least one stream of cylindrical objects to be packaged, traveling substantially end to end along at least one path to the container receiving surface. The direction of travel of the cylindrical objects as the objects approach the container receiving surface is substantially perpendicular to the direction of travel of the containers near the container receiving surface. The cylindrical objects travel in a path whose centerline is substantially parallel to the container receiving surface at a point just prior to insertion into the containers.

The present invention also includes a means for positioning each container on the container receiving surface prior to insertion of the cylindrical object, and for releasing the filled containers after loading from the container receiving surface.

The present invention also includes a method of inserting cylindrical objects into a cylindrical container, comprising a first step of delivering at least one cylindrical container to a container receiving surface the container receiving surface located on a reference plane which is at an angle other than zero with respect to the horizontal. The containers are delivered such that a central cylindrical axis of each container is positioned substantially parallel to the container receiving surface as the containers are delivered. The method includes a step of delivering a plurality of cylindrical objects to the container receiving surface in a direction of travel substantially parallel to the reference plane as the cylindrical objects approach the container receiving surface.

The method also includes the steps of holding the cylindrical container on the container receiving surface while the cylindrical object is inserted into the cylindrical container, inserting the cylindrical object into the container and releasing the filled container from the container receiving surface.

DETAILED DESCRIPTION OF THE PREFERRED EMBODIMENTS

Figure 1:
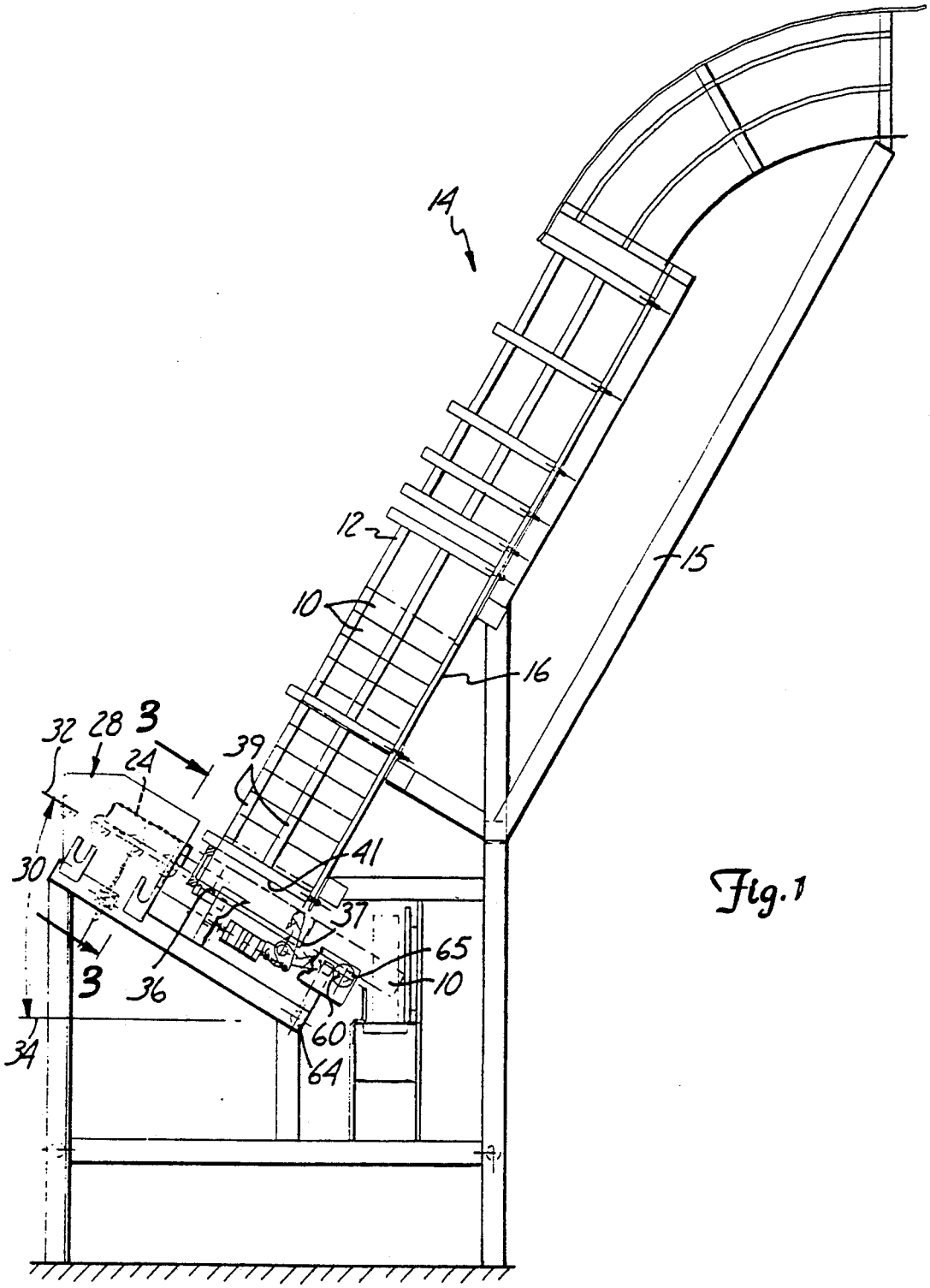
FIG. 1 is a side elevational view of a first preferred embodiment of the present invention.

In a first preferred embodiment of the invention illustrated in FIG. 1, a first conveyor 14 is provided for delivering a plurality of containers 10 through a staging area 12 of the conveyor 14. In the first preferred embodiment, the conveyor 14 is mounted to a portion of the frame 15 that rotates about a pivotal axis defined by a central axis of a shaft 64 rotatably mounted in the frame 15. The conveyor 14 is positioned above a container receiving surface 36 which delivers a plurality of cylindrical containers along a path which is substantially perpendicular to the container receiving surface 36. In the preferred embodiment, a central cylindrical axis of each container is substantially parallel to the container receiving surface as the containers approach the container receiving surface. Although the first preferred embodiment includes a staging area 12 which is capable of delivering a large volume of cans in a path substantially perpendicular to the container receiving surface, other conveyor configurations would also work. For example, the cans could be delivered horizontally until the cans come within a few feet of the container receiving surface, where the cans are then oriented to be delivered along a path substantially perpendicular to the container receiving surface.

In the first preferred embodiment, the container receiving surface 36 is located within a reference plane 32 which intersects a horizontal plane 34 defining an angle 30. In the preferred embodiment, the angle 30 of the container receiving surface 36 with respect to the horizontal is between 20 and 40 degrees, depending upon the surface characteristics and weight of the product to be packaged. The most preferred angle 30 is about 30 degrees when packaging surface frozen refrigerated cookie dough as described above.

The declining container receiving surface 36 is fixedly mounted at a first end 37 onto the shaft 64, the shaft 64 mounted for rotation in the frame 15. The angle 30 of the container receiving surface 36 with respect to the horizontal can be changed to accommodate a wide variety of processing conditions and products by rotating the container receiving surface 36 about a central axis of shaft 64. For example, if surface frozen dough segments 24 are being packaged, and the ambient temperature in the packaging plant rises without a corresponding increase in cooling temperature in the freezer, the surface temperature of the surface frozen dough segments 24 rise and the surf ace becomes more tacky. The angle 30 could be increased to compensate for the additional friction caused by the increased tackiness of the surface of the dough segments 24. A change in the product formula might also require adjustment to the angle 30. In practice, it is difficult to adjust the angle 30 because the position of the staging area 12 of the conveyor 14 must be changed. Therefore, it is preferable to select an angle 30 suitable for the product to be packaged before building the present invention.

The first conveyor 14 in the preferred embodiment is fixedly mounted in relation to the container receiving surface 36. Near the container receiving surface 36, the rails 39 are positioned substantially perpendicular to the container receiving surface 36. When the container receiving surface 36 is rotated about the shaft 64, the position of the first conveyor 14 also changes. However, the container receiving surface 36 remains perpendicular to a path of the cans 10 near the container receiving surface 36, defined by a direction of flow of the containers 10, regardless of the selection of the angle 30. Since the first conveyor 14 can deliver cans substantially horizontally, or in an inclining or declining manner with respect to the container receiving surface 36, all that is important is that the path be substantially perpendicular to the container receiving surface 36 as the containers approach the container receiving surface 36. For example, in FIG. 1, the path is horizontal until reaching the staging area 12 which is declining such that the path is substantially perpendicular to the container receiving surface 36 as the containers approach the container receiving surface 36.

Although in the preferred embodiment the conveyor 14 is mounted directly to a rotatable portion of the frame 15, the conveyor 14 could be mounted onto a separate frame. For example, the conveyor 14 could be suspended from above rather than supported from below. As long as the relative position of an exit end 41 of the conveyor 14 is substantially perpendicular to the container receiving surface 36, the device will function properly.

The containers 10 used in accordance with the device of the present invention typically are 2⅛ inches in diameter spiral wound composite cans having a metal cap (not shown) at one end. The containers are oriented with the metal cap next to the first side 16 of the first conveyor 14 and are transported by means of a magnetic cable (not shown) . other size containers could also be used to package elongated cylindrical objects with the device of the present invention.

The device of the present invention also includes a second delivery means which in the preferred embodiment is a roller conveyor 28. The second delivery means delivers the cylindrical objects along a path which near the container receiving surface 36 is substantially parallel to that surface, and which is aligned with each container 10 resting on the container receiving surface 36. With both the first conveyor 14 and the roller conveyor 28, the orientation of the paths of the containers 10 and the dough segments 24 relative to the container receiving surface 36 is important. However, the orientation of the path of the containers 10 as well as the dough segments 24 relative to the container receiving surface 36 at a point distant from the container receiving surface 36 is unimportant. Both conveyors 14 and 28 therefore can incline, decline, run substantially horizontally or substantially vertically until the materials being delivered to the container receiving surface approach that surface. Then the path of flow of the containers 10 must be substantially perpendicular to the container receiving surface 36 and the path of f low of the dough segments 24 must be substantially parallel to the container receiving surface 36. The dough segments 24 must also be delivered in alignment with an open end of each container 10 so that the objects are inserted by means of momentum from traveling along the roller conveyor 28.

Figure 2:
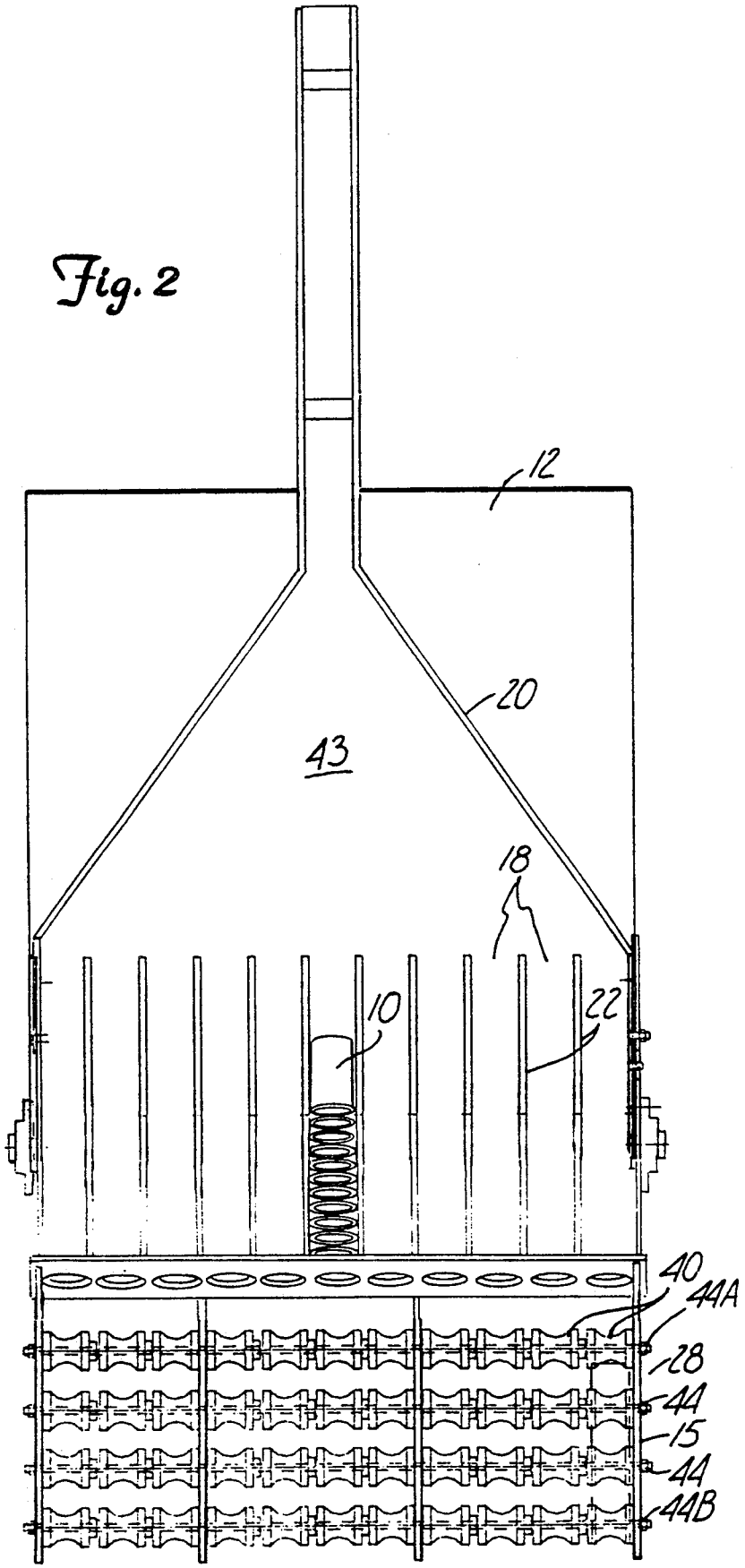
FIG. 2 is a top plan view of a preferred embodiment of the present invention.

A top plan view of a first preferred embodiment of the present invention is shown in FIG. 2. As illustrated in FIG. 2, the preferred device of the present invention loads a plurality of cans 10 at the same time. The staging area 12 of the first conveyor 14 is bordered by an upstanding diverter 20 and is divided into a plurality of lanes 18. A plurality of upstanding dividers 22 are provided to align each upstanding cylindrical container 10 maintained in the lanes 18. In the first preferred embodiment, the diverter 20 and dividers 22 are fixedly mounted on a substantially flat surface 43 in perpendicular relation to the surf ace 43. The diverter 20 in a preferred embodiment evenly distributes the containers 10 to each of the lanes 18.

Also illustrated in FIG. 2 is a detailed illustration of the roller conveyor 28 of the first preferred embodiment. A plurality of rollers 40 are mounted for rotation onto a plurality of rotatable shafts 44 within the frame 15. In the first preferred embodiment, eleven rollers 40 are mounted onto each shaft. The shafts 44 are mounted horizontally in the frame 15. The shaft 44A nearest the container receiving surface 36 (shown in FIG. 1) is vertically lower than the shaft 44B which is positioned further away from the container receiving surface 36. Each shaft 44A, 44B is located within a reference plane which is declining with respect to the horizontal in the first preferred embodiment.

In the first preferred embodiment, the dough segments (shown in FIG. 1) are conveyed horizontally to the roller conveyor 28 where the dough segments 24 (shown in FIG. 1) advance by means of gravity down the declining roller conveyor 28 onto the container receiving surface 36 (shown in FIG. 1). In another embodiment (not shown) , the shafts 44 are timed and are driven by means of a drive belt riding on a plurality of sheaves. The sheaves are mounted for rotation on the frame and driven by a motor which is also mounted onto the frame.

Figure 3:
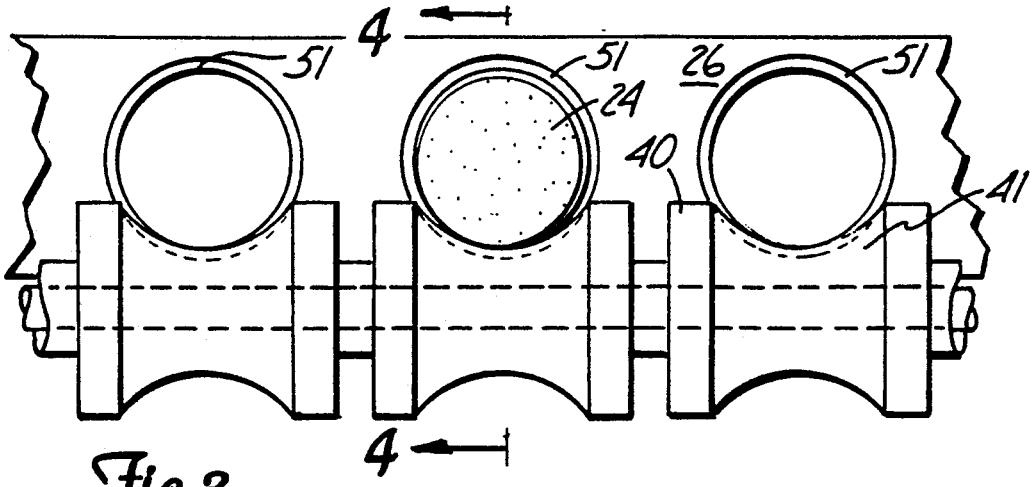
FIG. 3 is a cross-sectional view of a preferred embodiment of the second conveyor conveying cylindrical objects taken generally along line 3—3 as shown in FIG. 1.

FIG. 3 is a cross-sectional view of the roller conveyor of the first preferred embodiment, taken generally along line 3—3 as shown in FIG. 1. As illustrated in FIG. 3, the rollers 40 have concave outer surfaces 41 that substantially conform to the shape of the dough segments 24. The rollers 40 in the first preferred embodiment are positioned such that the dough segment 24 is delivered at a vertical height that corresponds to an opening in the container 10.

Figure 4:
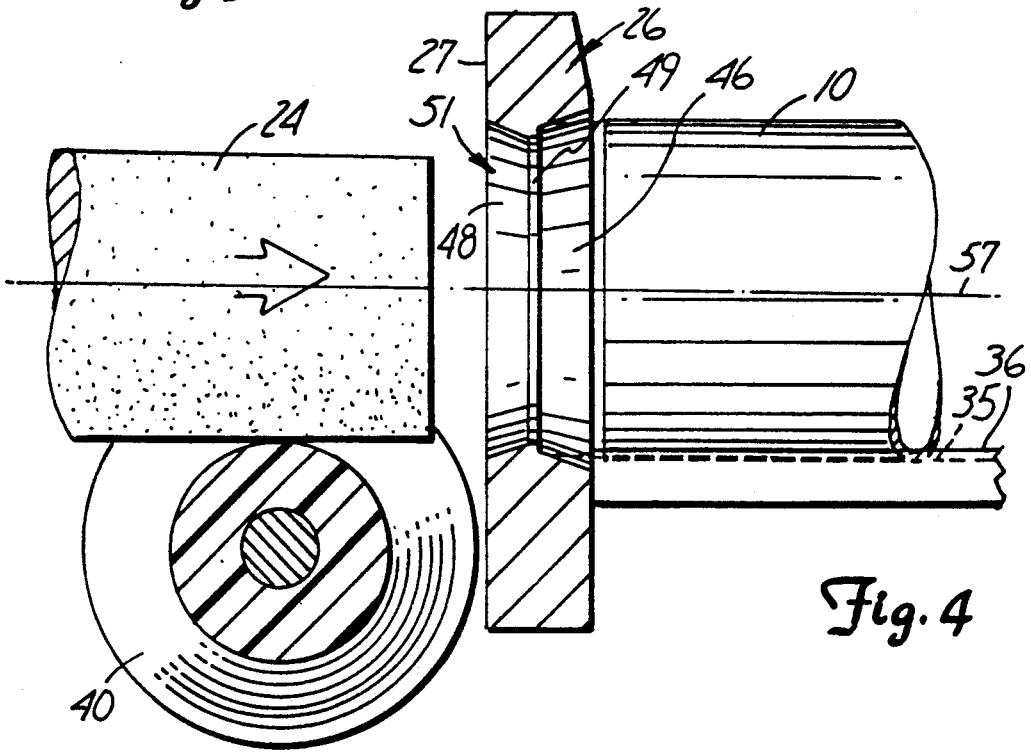
FIG. 4 is an expanded side elevational view of the present invention showing the second conveyor and an alignment ring of the first preferred embodiment as shown in FIG. 1.

The present invention also includes a means for positioning the cylindrical container on the container receiving surface 36 and for releasing a cylindrical container after loading from the container receiving surface 36. As illustrated in FIG. 4, in the first preferred embodiment, an alignment guide 26 is included as a means for positioning the cylindrical container on the container receiving surface and to cause an open end of flattened cans to be returned to their original cylindrical shape. A detent (not shown) is provided to hold the empty can in position within the alignment guide 26. The detent (not shown) should provide sufficient force to the can to allow the dough piece 24 to pass through the alignment guide 26 and completely into the interior of the can. An additional means for positioning each can 10 on the container receiving surface is a "V" shaped groove 35 (shown in phantom) extending below the container receiving surface 36 and having an axis parallel to and directly beneath the central axis 57 of the can 10.

The alignment guide 26 of the first preferred embodiment of the present invention has a through bore 51 defined by a first inner tapered surface 48, a cylindrical inner surface 49 and a second inner tapered surface 46. Surfaces 48, 49 and 46 define the through bore 51. The alignment guide 26 also has a first substantially flat outer surf ace 27. The alignment guide 26 is fixedly mounted in relation to the container receiving surface 36 in a manner such that the outer surface 27 is located within a plane which is substantially perpendicular to the surface 36. The alignment guide 26 is preferably mounted to the frame 15 (FIG. 1) . The alignment guide 26 could also be mounted to another structure, provided that the orientation of the outer surface 27 is fixed with respect to the container receiving surface 36 throughout the entire range of pivotal positions used to operate the device of the present invention. It is to be understood that in the first preferred embodiment, a central axis 57 of the through bore 51 is substantially perpendicular to the outer surface 27. What is important is that the alignment guide 26 is mounted such that a central axis 57 of the through bore 51 is spaced closely to or is substantially the same line as a central cylindrical axis 59 of the dough segment 24.

Tapered surface 46 is of a size large enough to receive an open end of a cylindrical container, to round the open end of the container 10 and to stop the container from traveling through the guide 26. In the preferred embodiment, the tapered surface 46 receives an open end of the cylindrial container, and the detent holds the container within the alignment guide 26 until the dough is completely within an inner cavity of the container. Tapered surface 48 is larger near the flat surface 27 to guide the segment 24 into alignment with an opening in the can 10. The tapered surface 48 guides the dough segment 24 through the guide 26 and into the container 10 when the roller conveyor 28 (shown in FIG. 2) delivers the dough segment 24 into the container. Preferably, the roller conveyor 28 (shown in FIG. 2) delivers the dough segments 24 with sufficient momentum to insert the segment 24 completely into the interior cavity of the container. Referring back to FIG. 3, a plurality of through bores 51 are provided in the alignment guide 26. One through bore 51 is provided per lane 18 (shown in FIG. 2).

Although the alignment guide 26 and groove 35 (shown in phantom in FIG. 4) are provided in the first preferred embodiment, any means for retaining the container on the container receiving surface 36 would be suitable for use with the present invention.

The first preferred embodiment of the present invention includes an additional means for positioning the cylindrical container on the container receiving surface 36. This additional means also releases the cylindrical container after loading from the container receiving surface.

Figure 5:
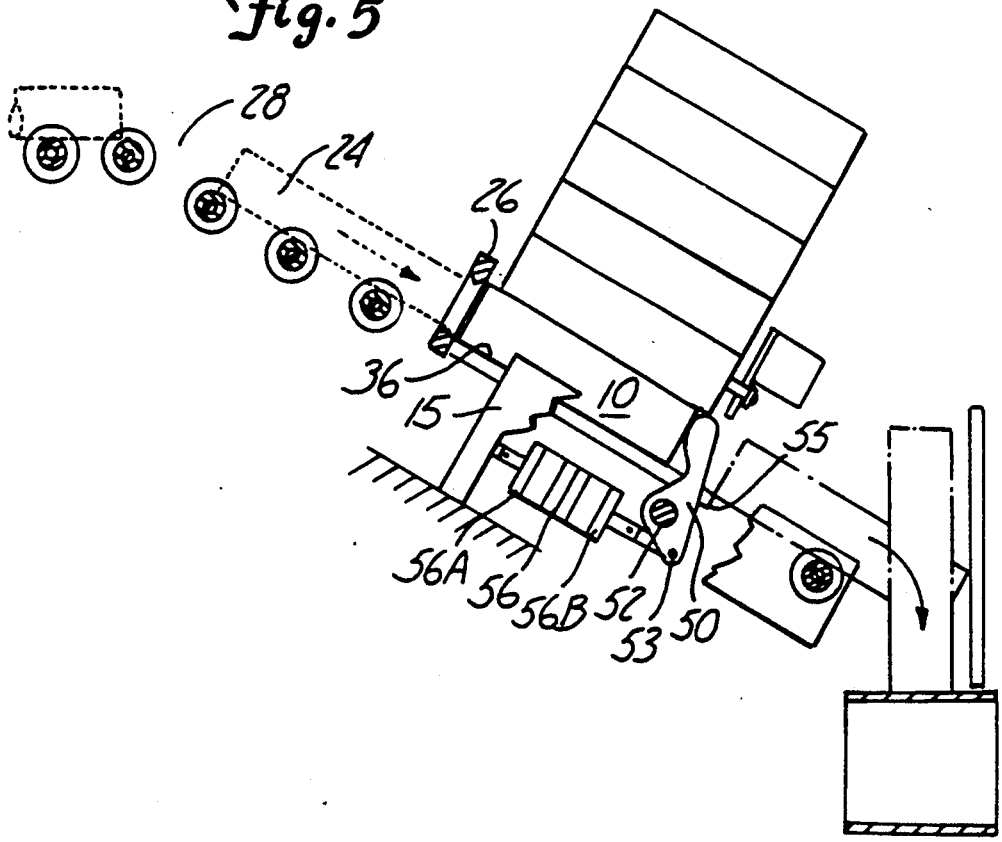
FIG. 5 is an enlarged side elevational view illustrating the container insert arm of the first preferred embodiment in a first position.

Referring now to FIG. 5, the additional means includes a container insert arm 50 pivotally mounted to the frame 15. The container insert arm 50 extends from below the container receiving surface 36 to above the container receiving surface 36 through a notch (not shown) extending from the lower end 55 of the container receiving surface 36. The insert arm 50 is pivotally mounted to a shaft 52, the shaft 52 being mounted in the frame 15 beneath the container receiving surface. A lower end 53 of the insert arm 50 is pivotally connected to an actuator such as a pneumatic cylinder 56 in the first preferred embodiment. In the first preferred embodiment, the actuator includes a dual action pneumatic cylinder 56 including a first pneumatic section 56A and a second pneumatic section 56B. The actuator is part of the means for positioning the container on the container receiving surface and for releasing the filled container from the container receiving surface 36. The pneumatic cylinder 56 is pivotally attached at one end to the frame 15, and at the opposite end to the lower end 53 of the insert arm 50. The cylinder 56 in the first preferred embodiment moves the insert arm 50 into three distinct positions which will be described in more detail below.

Figure 6:
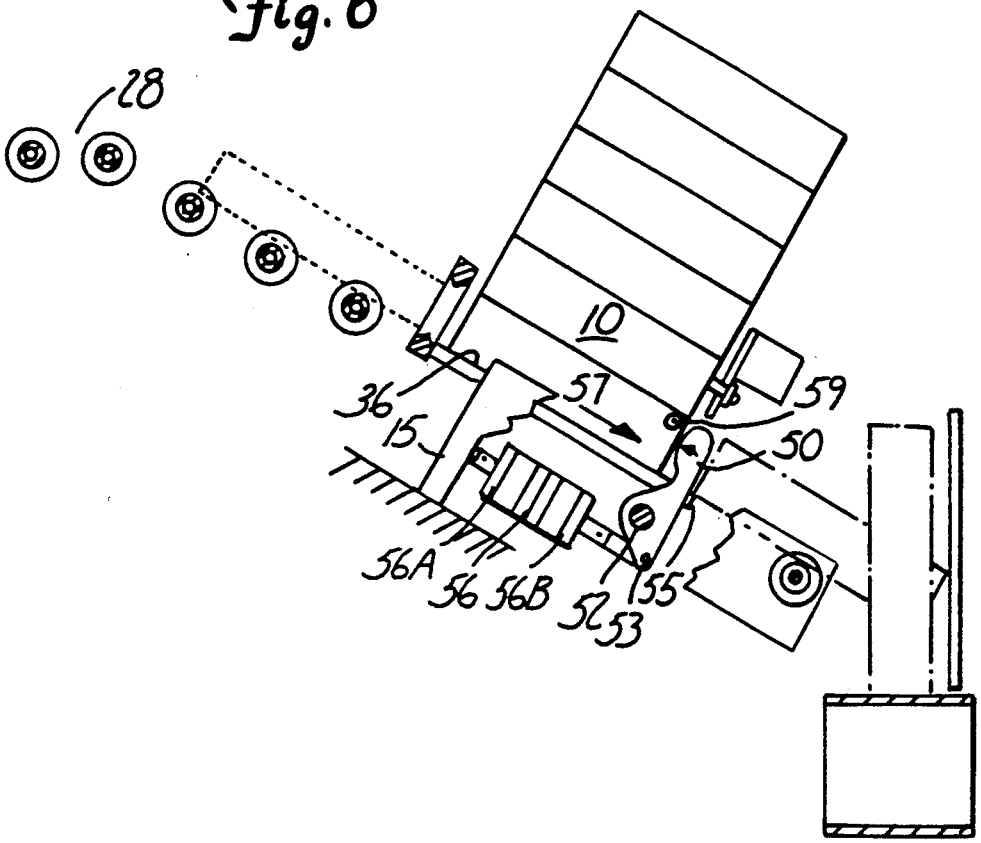
FIG. 6 is an enlarged side elevational view illustrating the container insert arm of the first preferred embodiment in a second position.
Figure 7:
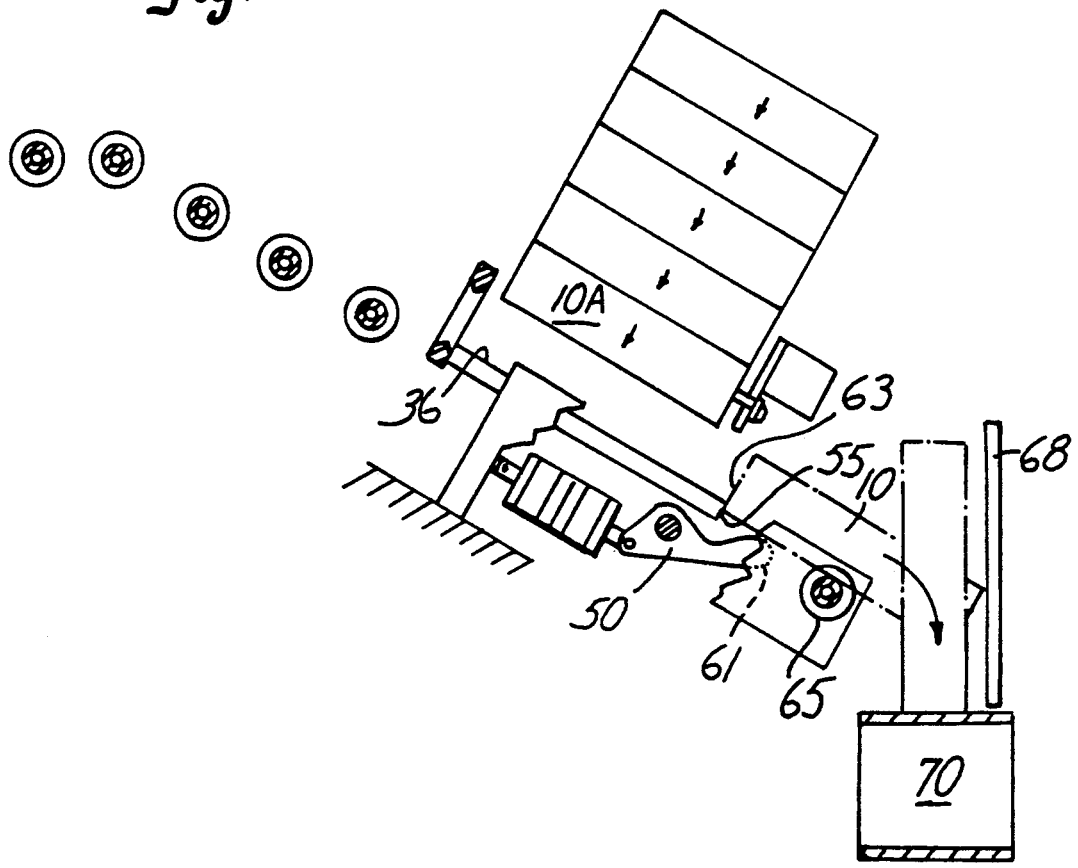
FIG. 7 is an enlarged side elevational view illustrating the container insert arm of the first preferred embodiment in a third position.

During operation, the insert arm 50 moves by means of cylinder 56 into three distinct positions illustrated respectively in FIGS. 5 through 7. In the first position, the insert arm 50 as shown in FIG. 5 is positioned such that a container 10 already positioned on the container receiving surface 36 is advanced toward the roller conveyor 28 until an open end is inserted into the alignment guide 26. A detent (not shown) is provided for retaining the container 10 within the alignment guide 26 until a dough segment 24 is placed within a cavity of the container 10. After an open end of the container 10 is pressed into the alignment guide 26 by means of the insert arm 50, the insert arm 50 moves to a second position shown in FIG. 6. At this point, the system is in the "wait" mode. After the filled container 10 overcomes the force of the detent and begins moving in a direction shown by arrow 57, a closed end of the container 10 contacts the insert arm 50. The insert arm 50 preferably remains in the second position for a short period of time after the sealed end of the container 10 contacts the insert arm 50. If the dough segment 24 is not positioned completely within an inner cavity of the container 10 at this point, when the closed end hits the insert arm 50, the dough segment 24 moves completely within an inner cavity of the container 10.

When the filled container 10 contacts the insert arm 50 which is in the second position, an electric eye 59 located near the sealed end of the container becomes blocked. When the eye 59 becomes blocked, the insert arm 50 advances into a third position shown in FIG. 7.

In the third position, the upper end 61 of the insert arm 50 moves below the container receiving surface 36, allowing the filled container to slide off the lower end 55 of the container receiving surface 36 by means of gravity. After the trailing end 63 of the container 10 clears the opening of the first conveyor 14, the filled container travels over a roller 65 as it clears the container receiving surface 36 and the next container 10A drops onto the container receiving surface 36. After the next container 10A contacts the receiving surface 36 and before the container 10A begins to slide, the insert arm 50 returns to the first position shown in FIG. 5, advancing the container 10A into the alignment guide 26.

The first preferred embodiment of the present invention also includes a conveyor 70 for removing filled containers from the device of the present invention after filling. The conveyor 70 is of the type which receives cans which are tipped upwardly such that the cans stand vertically with the open ends facing up on the conveyor after loading. An example would be a magnetic conveyor similar to the type used to convey the empty containers 10 to the container receiving surface 36.

Figure 8:
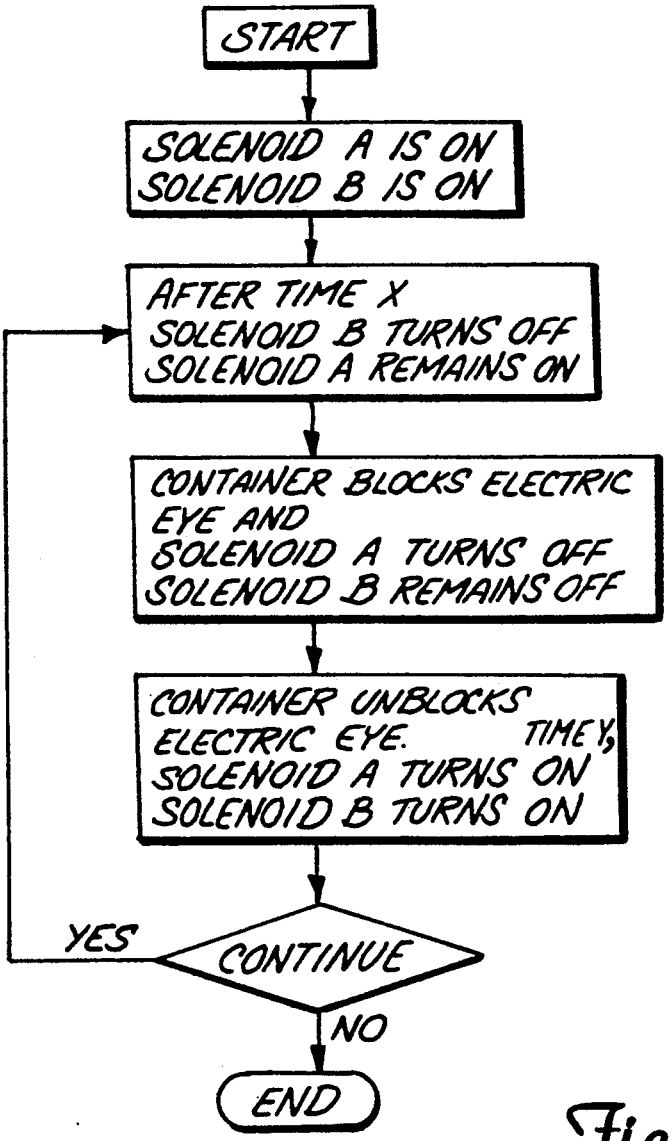
FIG. 8 is a schematic diagram of a preferred control scheme of the device of the present invention.

The operation of the container insert arm 50 is controlled by a control circuit illustrated by the flow diagram shown in FIG. 8. Two solenoids are used to control the position of the container insert arm 50 by activating an actuator on the air cylinder 56. These solenoids are designated solenoid A and solenoid B in the first preferred embodiment. When the can loader of the first preferred embodiment is energized, solenoid A is energized and solenoid B is energized. The container insert arm 50 moves into the first position (illustrated in FIG. 5) and a container 10 which is already located on the receiving surface 36 advances until an open end moves into the alignment guide 26.

An electric eye 59 (shown in FIG. 6) is provided near the sealed end of the container 10 when the container is resting on the insert arm 50 and when the insert arm 50 is in the second position as shown in FIG. 6. A first timer is provided which prevents the electric eye 59 from sensing the presence of the empty container 10 for an amount 6f time X after being dropped to the container receiving surface 36, and prior to advancing the insert arm 50 to the first position shown in FIG. 5. At the conclusion of time X, solenoid A remains energized and solenoid B is deenergized. In response, the insert arm 50 moves into the second position (shown in FIG. 6).

When the container 10 is in the position shown in FIG. 6, the process is in a "wait" mode. After the roller conveyor 28 delivers the dough segment 24 into the container 10, the filled container 10 slides by means of gravity down the container receiving surface 57 until the sealed end contacts the insert arm 50 which is in the second position shown in FIG. 6. The electric eye 59 then senses the presence of the filled container, and deactivates solenoid A. Solenoid B remains off. In response, the insert arm 50 moves to a third position shown in FIG. 7. An upper end of the insert arm 50 is then positioned below the container receiving surface 36. The filled container 10 slides off the receiving surface 36 and over a roller 65 mounted onto the rotational shaft 60. The rotational shaft 60 is mounted within the frame 15. The angle 30 between the receiving surface 36 and the horizontal 34 must be large enough to cause the filled container 10 to slide off the receiving surface 36 without additional means of propulsion. However, if the angle 30 is too large, the containers move at f aster speeds and result in excessive process noise. For this reason, it is preferred that the angle 30 is selected to minimize noise yet provide enough momentum to remove the filled container 10 from the container receiving surface 3 6 without additional means. The preferred range of angles is between about 20 and 40 degrees with a most preferred angle of about 30 degrees. After the filled container 10 slides over the roller 65, the container 10 contacts a vertical deflector board 68, as shown in FIG. 7, and lands in a vertical position on the conveyor 70.

Referring back to FIG. 8, as the filled containers 10 slide off the receiving surface 36, the electric eye once again senses a light beam which was previously blocked by the container 10 (not shown). The unblocking of the light beam causes the timer which measures time X to reset.

A second timer is preferably provided which causes a time delay Y between the sensing of the light beam after releasing the filled container, and before reenergizing both solenoid A and solenoid B.

During the time when the insert arm 50 is in the third position shown in FIG. 7, and after a trailing end 63 of the filled container 10 has cleared the area of the container receiving surface 36 directly beneath the conveyor 14, the next container 10 drops onto the container receiving surface 36. The time delay Y is selected such that the next advancing container has sufficient time to reach the surface 36, but not enough time to slide off the surface 36.

When solenoids A and B are reenergized, the system is now at the starting configuration and the process may be repeated as desired.

Figure 9:
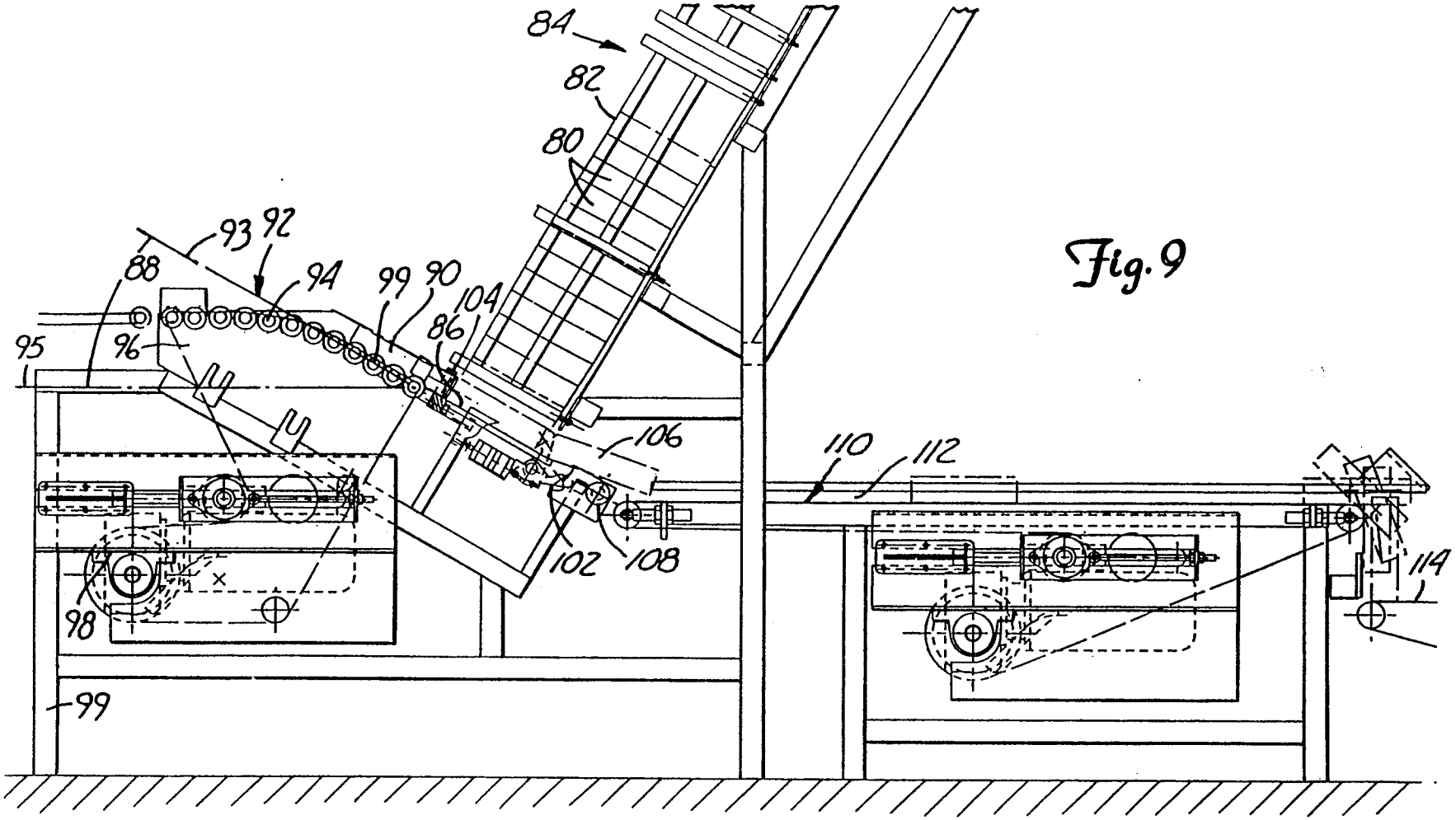
FIG. 9 is a side elevational view of a second preferred embodiment of the present invention.

In a second preferred embodiment illustrated in FIG. 9, the containers 80 are delivered to a staging area 82 on a container conveyor 84 similar to the container conveyor described with respect to the first preferred embodiment. In the staging area 82, the containers 80 are distributed into a plurality of lanes (only one lane is illustrated). Since the filling of the containers 80 in each of the lanes is identical, only one lane will be described.

The lowermost container 80 in each lane rests upon a receiving surface 86. The receiving surface 86 in the second embodiment is pivotally mounted to the frame in the same manner as described in the first preferred embodiment. The orientation of the conveyor 84 relative to the container receiving surface 86 is also substantially identical to that shown in the first preferred embodiment.

A second conveyor 92 is provided which in the preferred embodiment is substantially horizontal until the dough segments reach a declining section 99 of the conveyor 92. The second conveyor 92 of this preferred embodiment is driven by means of a motor driven belt 96. The container receiving surface 86 is contained within a reference plane 93. This reference plane 93 is declining with respect to a horizontal plane 95 defining an angle 88 that is similar to the angle of the first preferred embodiment. However, the angle 88 of the receiving surface in this embodiment can be smaller than the angle of the receiving surface in the first preferred embodiment because the dough segment 90 is propelled into the containers 80 in this embodiment on a motorized dough conveyor 92.

Figure 10:
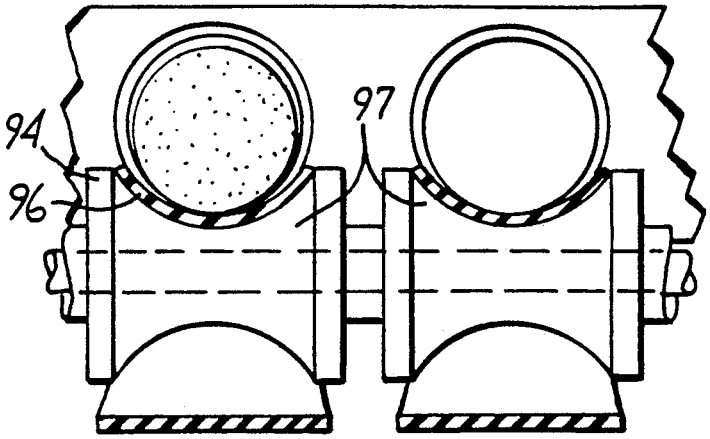
FIG. 10 is a cross-sectional view of the second conveyor of a second preferred embodiment showing an endless moving member traveling across an upper surface of a plurality of rollers.

The dough conveyor 92 in this embodiment is similar to the dough conveyor described with regard to the first preferred embodiment in that the rollers 94 on which the dough 90 is conveyed have inwardly curved outer surfaces that are shaped to receive the dough. However, as illustrated in FIG. 10, the rollers 94 have concave outer surfaces 97 which are covered by an endless belt 96 that conforms to the shape of the roller surface. The endless belt 96 is preferably formed from a flexible polymer material such as butyl rubber.

Referring back to FIG. 9, the endless belt 96 is driven by a motor 98 mounted to the frame 99 and operates at a sufficient speed such that the piece of dough 90 is propelled completely into the container 80.

As described in the first preferred embodiment, the dough segments 90 are delivered along a path which is substantially parallel to the container receiving surface 86, near the container receiving surface 86. The containers 80 are fed such that a line defined by the path of the containers near the container receiving surface 86 is perpendicular to the container receiving surface 86 as with the first preferred embodiment.

The construction and operation of the container insert arm 102 and its accompanying control circuitry in this embodiment is the same as the first preferred embodiment. The container insert arm 102 is in a third position as the container 80 falls from a lane in the staging area 82 to the receiving surface 86. The container insert arm 102 then shifts to a first position and pushes the container 80 against the alignment guide 104. After a time delay, the container insert arm 102 shifts to a second position. After the container 80 is filled, an electric eye is blocked as the filled container contacts the insert arm 102, and the insert arm 102 moves to a third position that is below the receiving surface. This allows the filled container 106 to slide over a roller 108 and onto a conveyor 110.

The conveyor 110 is substantially horizontal and utilizes a motorized endless belt 112 to transport the filled containers 106 away from beneath the container receiving surface 86. Upon reaching the end of the conveyor 110, the container 106 is changed to a vertical orientation and -it is deposited onto yet another conveyor 114. The manner of transporting the filled container is not essential to this invention and the filled container 106 may be transported on a conveyor system similar to the one described with regard to the first embodiment.

The present invention not only relates to the apparatus, but also to a process of inserting a cylindrical object such as a piece of dough into a cylindrical container. The process includes a first step of delivering a cylindrical container to a container receiving surface, the container receiving surface located in a reference plane which is at an angle with respect to the horizontal. The containers travel along a path which near the container receiving surface is substantially perpendicular to the container receiving surface. Each container has a central cylindrical axis which is substantially parallel to the container receiving surface as each container approaches that surface.

The method of the present invention also includes the step of delivering a plurality of cylindrical objects to the container receiving surface in a direction of travel substantially parallel to the container receiving surface, and substantially perpendicular to a direction of travel of the containers near the container receiving surface. It is to be understood that what is important is that as the cylindrical objects approach the container receiving surface, the objects are delivered to the container receiving surface in the fashion described above and are in alignment with an opening in the container.

The method of the present invention also includes the step of holding the container on the container receiving surface such that the cylindrical object can be inserted into the container while the container remains stationary. A preferred method includes retaining the container in a first position, and advancing the container in a direction opposite a direction of flow of the cylindrical objects.

The method also includes the steps of inserting the cylindrical object into the container, and releasing the filled containers from the container receiving surf ace. The preferred method of release includes positioning the containers to be filled at an angle with respect to the horizontal between about 20 and about 40 degrees, with a preferred angle of about 30 degrees when packaging refrigerated dough products. The method also includes releasing the containers after filling and allowing the filled containers to slide off the declining container receiving surface by means of gravity.

The preferred method of the present invention also includes the additional step of removing the filled containers from an exit end of the container receiving surface after filling.

Although the present invention has been described with reference to preferred embodiments, workers skilled in the art will recognize that changes may be made in form and detail without departing from the spirit and scope of the invention.

What is claimed is:

1. A device for inserting cylindrical objects into cylindrical containers, comprising:

a frame;

a surface pivotally mounted to the frame, located within a surface plane which is angled with respect to the horizontal, wherein an intersection of the reference plane and the horizontal defines a first angle;

first delivery means positioned substantially perpendicular to the surface near the surface, wherein the first delivery means delivers each cylindrical container to the surface;

aligning means for aligning the cylindrical objects into a plurality of lanes;

second delivery means for delivering cylindrical objects to the surface along a path which near the surface is substantially parallel to the surface and for inserting at least one cylindrical object into an open end of the cylindrical container; and means for positioning the cylindrical container on the surface and for releasing the cylindrical container after loading from the surface.

2. The device of claim 1, wherein the first angle is selected such that after the cylindrical object is inserted into the container, the container slides completely off of the surface after the container is released.

3. The device of claim 1, wherein the first angle is between 20 and 40 degrees.

4. The device of claim 1, wherein the second delivery means comprises a plurality of concentric rollers mounted onto the shaft.

5. The device of claim 4, and further comprising an endless moving member positioned over at least a portion of each of the concave outer surfaces of the rollers, and further comprising a means for driving the endless moving member at a rate sufficient to cause the cylindrical objects to be propelled completely into the containers.

6. The device of claim 1 wherein the means for aligning the cylindrical objects comprise a plurality of spaced apart dividing walls positioned in a direction of travel of the cylindrical containers.

7. The device of claim 1 wherein means for aligning cylindrical objects comprises an alignment guide having an aperture with a central axis substantially parallel to the reference plane, wherein the container alignment means is mounted to the frame in fixed relation to the surface.

8. The device of claim 7 wherein the aperature is defined by at least two frusto-conical shaped surfaces.

9. The device of claim 1 wherein the means for positioning the cylindrical container and for releasing the cylindrical container comprises a multi-position container insert arm pivotally mounted onto the frame.

10. The device of claim 7, wherein the means for positioning the cylindrical container and for releasing the cylindrical container comprises an arm pivotally mounted onto the frame, wherein the arm positions an open end of the cylindrical container against one of the frusto-conical shaped surfaces in the container alignment means prior to the second delivery means causing the cylindrical object to be inserted into the container.

11. The device of claim 10, wherein the means for positioning the cylindrical container on the surface and for releasing the cylindrical container after loading further comprises at least one pneumatic cylinder mounted to the frame for changing the position of the arm.

12. The device of claim 11 and further comprising control means comprising two solenoids and an electronic eye for controlling the operation of the pneumatic cylinders.

13. The process of claim 1 wherein releasing the cylindrical container includes removing the filled container from the surface by gravity.

14. The device of claim 1 wherein the means for positioning the cylindrical container comprises an elongated groove extending through the surface.

* * * * *

UNITED STATES PATENT AND TRADEMARK OFFICE

CERTIFICATE OF CORRECTION

PATENT NO. : 5,305,808

DATED : April 26, 1994

INVENTOR(S) : Rasmussen et al.

It is certified that error appears in the above-indentified patent and that said Letters Patent is hereby corrected as shown below:

On the Title Page of the Patent, in [57] Abstract, line 12, delete "surf ace", insert --surface--.

Col. 1, line 9, delete "f or", insert --for--.

Col. 2, line 7, delete "plant", insert --plane--.

Col. 4, line 1, delete "surf ace", insert --surface--.

Col. 4, line 48, delete "other", insert --Other--.

Col. 5, line 3, delete "f low", insert --flow--.

Col. 5, line 21, delete "surf ace", insert --surface--.

Col. 6, line 15, delete "surf ace", insert --surface--.

Col. 8, line 25, delete "6f", insert --of--.

Col. 8, line 51, delete "f aster", insert --faster--.

Col. 8, line 56, delete "surface 3 6", insert --surface 36--.

UNITED STATES PATENT AND TRADEMARK OFFICE

CERTIFICATE OF CORRECTION

PATENT NO. : 5,305,808

DATED : April 26, 1994

INVENTOR(S) : Rasmussen et al.

It is certified that error appears in the above-indentified patent and that said Letters Patent is hereby corrected as shown below:

Col. 10, line 23, delete "-it", insert --it--.

Col. 10, line 63, delete "surf ace", insert --surface--.

Col. 11, line 18, delete "surface", insert --reference--.

Col. 12, lines 23-24, delete "and for releasing the cylindrical container".

Signed and Sealed this

Fifth Day of September, 1995

*Attest:*

Bruce Lehman

BRUCE LEHMAN

*Attesting Officer*

*Commissioner of Patents and Trademarks*